US005288019A

United States Patent [19]

Gorochow

[11] Patent Number: 5,288,019

[45] Date of Patent: Feb. 22, 1994

[54] BEVERAGE COOLING SIPPER

[76] Inventor: Erica Gorochow, 13108 Brushwood Way, Potomac, Md. 20854

[21] Appl. No.: 16,007

[22] Filed: Feb. 10, 1993

[51] Int. Cl.[5] ..... A47G 21/18; A61J 15/00

[52] U.S. Cl. ..... 239/33; 239/132; 62/338; 62/457.3

[58] Field of Search ..... 239/16, 24, 33, 128, 239/132; 62/338, 457.2, 457.3, 371, 372, 530

[56] References Cited

U.S. PATENT DOCUMENTS

| | | | |
|---|---|---|---|
| 2,370,931 | 3/1945 | Bogin et al. | 239/33 X |
| 4,091,632 | 5/1978 | Marchewka et al. | 62/530 X |
| 4,658,990 | 4/1987 | Ramage | 239/33 X |
| 4,733,785 | 3/1988 | Turner, Jr. et al. | 239/33 X |
| 5,009,083 | 4/1991 | Spinos et al. | 62/457.3 X |
| 5,031,831 | 7/1991 | Williams, III | 239/33 |
| 5,129,239 | 7/1992 | Schwartz et al. | 62/457.3 |

*Primary Examiner*—Andres Kashnikow
*Assistant Examiner*—William Grant
*Attorney, Agent, or Firm*—Morton Chirnomas

[57] ABSTRACT

The present invention relates to a drinking device which, after suitable refrigeration, acts as a heat exchanger to draw heat from a hot liquid, thereby delivering cooled beverage to the user's mouth. The device includes flexible, concentric inner and outer tubes, the inner tube comprising a length of flexible, beverage grade tubing having an outer diameter at least 1/16 of an inch less than the inner diameter of the outer tube and a length at least thirty percent greater than that of the outer tube. An air space between the tubes is filled with a thermally conductive, non-toxic solid, forming the heat exchanger portion of the device. The outer tube is attached to the inner tube in a first position, such that an exposed small section of the inner tube forms a mouthpiece, and at a second position, such that the air space is formed, and at least two inches in length of the inner tube which is exposed beneath the second position forms an intake end, whereby the heat exchanger portion remains essentially unsubmerged in the beverage, thereby cooling only liquid drawn up by the user.

18 Claims, 4 Drawing Sheets

BEVERAGE COOLING SIPPER

FIELD OF THE INVENTION

The present invention relates to a devices which may be referred to as a hot drink sipper for allowing children and infirm adults to casually and safely drink scalding liquids by cooling said liquid as it is drawn through the device without cooling the bulk of the liquid. More particularly the present invention comprises a heat exchanger having a chamber filled with a solid thermal conductor which is charged for use by refrigeration and through which the liquid is drawn through by the users mouth.

BACKGROUND OF THE INVENTION

The benefits and soothing therapeutic effects of drinking warm liquids such as broths, teas, cocoas and the like are well known and are particularly desirable for persons in health care situations such as those in rehabilitation settings. Typically, patients undergoing physical rehabilitation or those weakened by a pathological state or the effects of drug therapies are unable to take in adequate quantities of nourishing hot beverages on their own The danger of scalding is significantly greater with these individuals, as it is with children, and close supervision of their mealtime is therefore required.

It has proven to be highly desirable to protect patients and children, while at the same time allowing them to independence to feed themselves as well as to derive the benefits of imbibing hot nutritive beverages. However, a health care setting requires that any device for cooling a patient's broth must have east of manipulation by the patient, disposability or ease of cleaning for reuse and safeguards against contaminating the beverage.

It is known in the art of beverage sipping devices, such as drinking straws, to construct straws from which a flavoring additive may be dispersed into the main body of liquid beverage as the beverage is consumed. For instance, U.S. Pat. No. 3,615,595 to Guttag discloses a straw having a double walled configuration with an inner wall comprised of a water insoluble material having dispersed therein a water-soluble flavoring. As the main beverage is sucked through the straw, the patent discloses that the water-soluble flavoring would leach out of the polymer and into the beverage.

Similarly, U.S. Pat. No. 2,867,536 to Mead et al. discloses a flavor-imparting straw using a double-walled configuration in which a flavoring is stored in the compartment formed between the outer and inner walls of the straws. However, neither of the disclosed devices will accomplish any modulation of the temperature of the beverage being consumed.

U.S. Pat. No. 2,288,848 also discloses a beverage drinking straw utilizing a double-walled configuration. Int his instance, the chamber formed by the double-wall provides buoyancy to the straw, thereby preventing it from sinking prematurely to the bottom of a soda bottle.

U.S. Pat. No. 3,957,202 relates to a novelty drinking straw having disposed thereon a chromatogenic liquid crystalline material which is maintained on the outer surface thereof under a film of Mylar or the like.

None of the above references relates to a device intended to modulate the temperature of the beverage product flowing through it.

U.S. Pat. NO. 5,031,831 to Williams relative to a device for cooling a room temperature liquid beverage comprising a pressurized canister having a wound capillary tube passing therethrough. The capillary tube is surrounded by frozen water, ammonium nitrate and water, glycerol, metal spheres and/or a pressurized gas. While this device may cool liquids draw through it, it suffers from numerous disadvantages. The device is complex and therefore expensive to produce and sell. Secondly, if the device should discharge any of the coolant materials, it could seriously injure an unknowing user. Additionally, as only the very ends of the device are pieces of common plastic drinking straws, the bulk of the device must be sterilized and recharged should reuse in a health environment be desirable. Moreover, again with respect to use by the infirm, the device is relatively difficult to use by a weakened person in a rehabilitation setting.

OBJECTS AND SUMMARY OF THE INVENTION

Therefore, it is an object of the present invention to provide a disposable heat exchanging device for cooling hot liquid beverages.

It is a further object to the present invention to provide a heat exchanging device for cooling hot beverages which is easily manipulable by weakened or hospitalized individuals.

It is yet a further object of the present invention to provide a heat exchanging device for cooling hot beverages wherein only a mouthful of the bulk of beverage which is drawn up by the consumer is significantly cooled while the bulk of the remaining beverage remains hot.

It is still a further object of the present invention to provide a heat exchanging device for cooling hot beverages wherein no liquid coolants or insulants are utilized which if accidentally discharged, could be imbibed to the detriment of the user's health.

These and other objectives are achieved by the present invention which relates to an ingenious, yet elegant solution to the problem of providing an inexpensive, yet effective device for cooling a hot liquid beverage as it is imbibed. The present invention largely comprises an inner tube having an axial bore running therethrough, the tube preferably being constructed from a flexible beverage grade thermoplastic. Surrounding a substantial portion of the upper part of the inner tube there is attached a larger diameter outer tube from the same material having a shorter length than the inner tube. Both ends of the outer tuber are attached or connected to the inner tube, near an upper end thereof by means such as heat sealing or by means of disk-like caps through which the inner tube passes and which seat firmly in the ends of the outer tube. Contained therein is a solid, thermally conductive heat exchanging material having a relatively high surface area for heat exchange. The solid material may be small polyethylene or polypropylene beads, for example.

The present invention is primed for use by refrigerating at a temperature of about 35 to 45 degrees Fahrenheit for a period of about three hours. A user submerses the lower end of the inner tube, designated so by the length to which it extends beyond the outer tube, and further indicated by indicia provided thereon, into the scalding hot liquid beverage. Placing her mouth on the mouthpiece end of the device, also bearing identifying indicia, the user applies a suction to the mouthpiece drawing the scalding liquid up into the inner tube. By the time the liquid has reached the users mouth, it has been cooled sufficiently to allow comfortable drinking of a still warm beverage.

BRIEF DESCRIPTION OF THE DRAWINGS

For a more complete understanding of the rpesent invention, reference may be had to the following detailed description considered in conjunction with the accompanying drawing, in which.

DETAILED DESCRIPTION OF THE PREFERRED EMBODIMENTS

The present invention relates to a drinking device which modulates, and preferably cools, the temperature of fluids drawn therethrough by a user's mouth. The device acts as a heat exchanger to draw heat from a hot liquid, or deliver heat to a cool liquid as desired, and thereby deliver cooled or warmed beverage to the user's mouth.

Generally speaking, the device comprises a flexible outer tube preferably made of a material such as beverage grade tygon, P.E.T. or polypropylene. The wall thickness of the tubing preferably should not exceed ⅛ of an inch. The outer tube is provided having a inner and outer diameter and a length of from four inches to fifteen inches.

The outer tube has placed concentrically therewithin an inner, cylindrical tube, the inner tube comprising a length of flexible, beverage grade tubing having a second inner diameter and a second outer diameter at least 1/16 of an inch less than the inner diameter of the outer tube. The tubing should be sufficiently flexible along its entire length that it does not collapse when bent to form at least a 45° arc and preferably at least a 90° arc. The length of the inner tube is at least thirty percent greater than that of outer tube. The air space between the outer surface of the inner tube and the opposite surface of the outer wall is filled with a thermally conductive, non-toxic solid having a high surface area. For example polyurethane foam, polyethylene beads or polypropylene beads having a size of from about 0.1 mm to about 5 mm. Preferably the beads have a bore therethrough, such as with those used for designing beaded clothing and jewelry, for the purpose of increasing surface area as much as 50% and thereby increasing heat exchange efficiency.

The upper end of the outer tube is attached at an upper end proximate to the upper end of inner tube in a position such that a small section of the inner tube comprising a mouthpiece is exposed above the attachment point. The attachment may be achieved by means of heat sealing, thermal shrinking or adhesive bonding. Alternatively, as will be described further hereinbelow, caps which slide down over the inner tube and engage the edges or rim of the outer tube may be utilised. The lower end of the outer tube is similarly attached to the inner tube at a second position such that a section of from 2 to 3 inches in length of the inner tube comprising an intake end is exposed below the second attachment point. Thus, the thermally conductive, non-toxic solid s sealed between the opposite surfaces of the inner tube and the outer tube between the first attachment point and the second attachment point, thereby, providing a heat exchanger device which remains essentially unsubmerged, out of the beverage, thereby allowing the bulk of the beverage to retain its hot (or cold) temperature.

Figure 1:
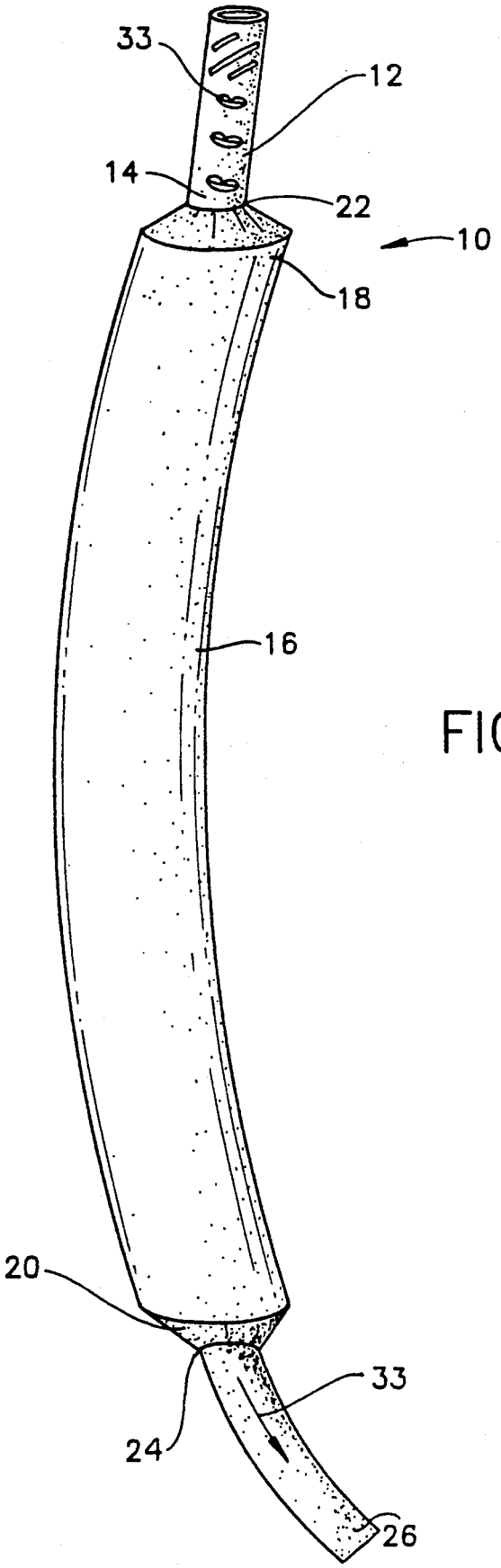
FIG. 1 is a perspective view of a drink cooling device constructed in accordance with one exemplary embodiment of the present invention.

With particular reference to FIG. 1, there is shown a drink cooling device 10 constructed in accordance with the present invention having an outer tube 16 having an overall length of from 4 to about 15 inches, and preferably from 7.5 to about 13 inches. An inner tube 12 has an inner diameter of from ⅛ to about ⅜ of an inch and an outer diameter of from 3/16 to about ½ of an inch. Inner tube 12 has the outer tube 16 attached around its outer surface 14, the outer tube 16 having an inner diameter at least 1/16 of an inch, and preferably ⅛ of an inch, greater than the outer diameter of inner tube 12. Inner tube 12 preferably has a length such that outer tube 16 has a length from 20% to about 40% less than inner tube 12. Outer tube 16 is sealed at its upper end 18 and lower end 20 to inner tube 12 at upper attachment point 22 and lower attachment point 24 respectively. Lower attachment point 24 is situated a minimum of at least 2 to 3 inches and preferably from 3 to 4 inches from lower end 26 of inner tube 12. This is desirable so that the device will not have a cooling effect (or warming as the case may be) on the bulk of the beverage or other fluid comestible.

Figure 2:
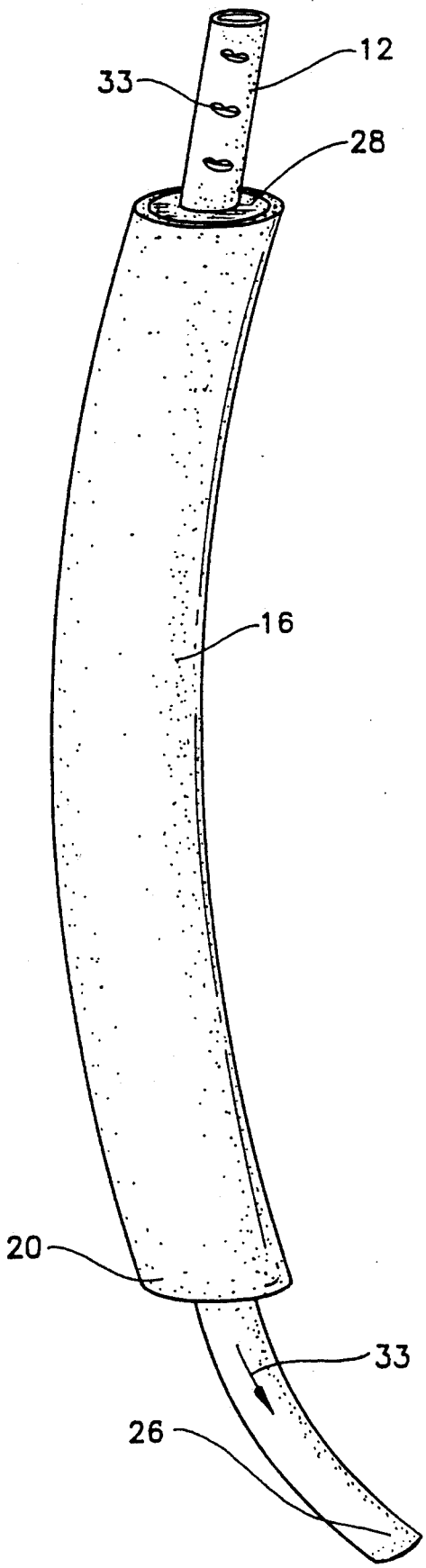
FIG. 2 is a perspective view of a drink cooling device constructed in accordance with another exemplary embodiment of the rpesent invention.
Figure 3:
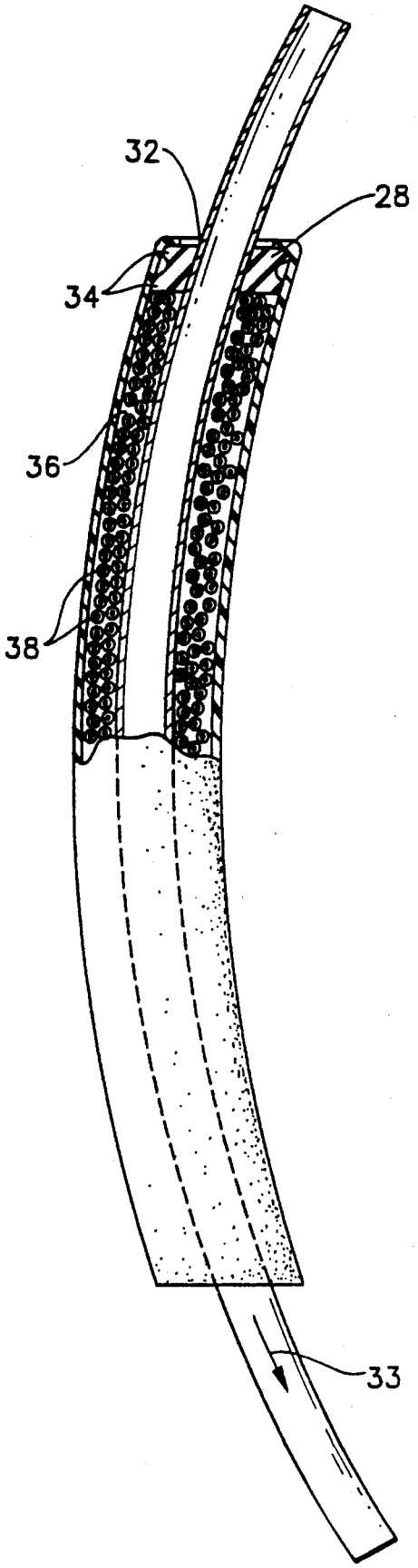
FIG. 3 is a partial cross-sectional view of the exemplary embodiment of the drink cooling device illustrated in FIG. 2 above.
Figure 4:
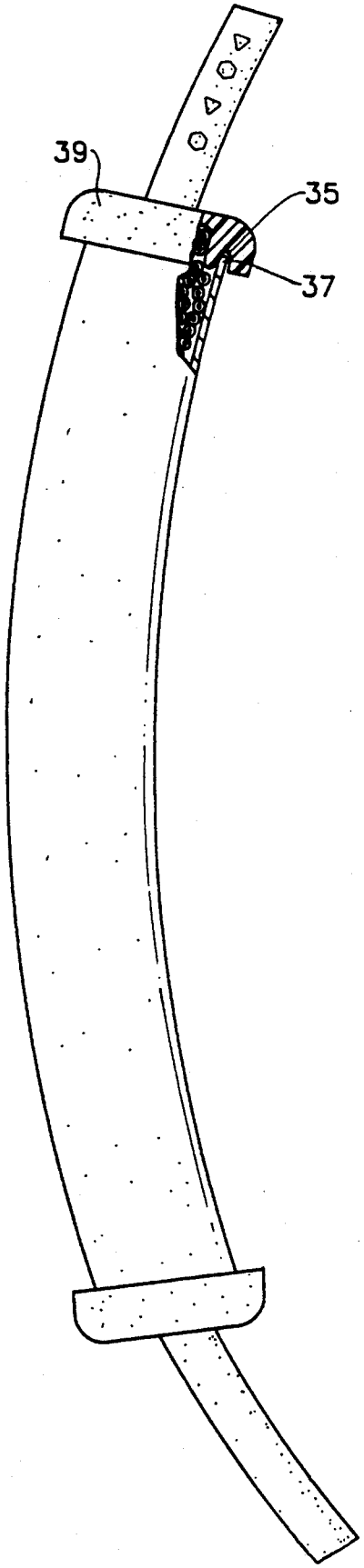
FIG. 4 is front elevation view of a drink cooling device constructed in accordance with another exemplary embodiment of the present invention.

The attachment of tubes 12 and 16 may be accomplished by heat sealing or adhesive bonding as shown in FIG. 1. For example, a chemical sealant such as an epoxy may similarly be used to achieve the same effect. Sealing may also be accomplished by use of end caps 28 as shown in FIGS. 2–4. The end caps 28, which may be made of a beverage grade silicon type rubber or other suitably pliant material would be constructed having a central opening 32 sized to fit snugly around inner tube 12 and an outer double-flanged rim 34 sized to either fit snugly into the opening of outer tube 16 or having an annular recess on an underside thereof to receive the rim of outer tube 16. In either case, a sealing fit is achieved which prohibits the escape of the thermally conductive, non-toxic solid as is described further hereinbelow.

Air space 36 between attachment points 22 and 24 is thus maintained and contains therein a thermally conductive, non-toxic solid comprising polypropylene beads 38 having a small diameter. The size of beads 38 should range from 0.1 mm to about 5 mm, and preferably fall within the range of from 1 mm to 2 mm in diameter. To further increase the surface area and hence heat exchange efficiency of beads 38, they may each be provided with bores going axially therethrough. Examples of such a material includes the beads used for decorating clothing, accessories and jewelry. A further feature of using such a material is that when used in conjunction with a clear outer tubing, colors and designs of innumerable forms and artistic value may be created to enhance the appearance of the device and brighten the day of a little child or a patient.

An additional consideration is that the upper end and lower end of inner tube 12 should be provided with indicia to clearly designate the appropriate end which a user should use as a mouthpiece or submerge in to the beverage. Although failure to do so will not cause harm, it will reduce the effectiveness of the present invention.

In use for cooling, the device 10 is charged by placing a refrigerated environment at a temperature of from 35 to about 45 degrees Fahrenheit for a period of about three hours. After that time, the device is removed and the lower end of inner tube 12 is submerged into the hot beverage in question. The user then bends the mouthpiece to place it in the mouth (in the case of an invalid or infirm patient) and sucks normally. A drink having a temperature of rom 150° to 160° F. was found to have its temperature reduced to about 110° F. at the mouthpiece when using a device provided with an inner tube having a length of 12.5 inches and an outer tube of 9.5 inches. This cooling efficiency was sustained while a drink of 8 to 10 ozs. was consumed at a moderate rate.

It will be understood that the embodiments described herein are merely exemplary and that a person skilled in the art may make many additional variations and modifications without departing from the spirit and scope of the invention. All such modifications and variations are intended to be included within the scope of the invention as defined in the appended claims.

I claim:

1. A drinking device for modulating the temperature of fluids drawn therethrough by a user's mouth, said device acting as a heat exchanger to draw heat from about liquid and thereby deliver cooled beverage to the user's mouth, said device comprising a flexible outer tube having a first cross-sectional area, said outer tube comprising a length of flexible tube and having a first inner diameter and a first outer diameter, said outer tube having placed concentrically therewithin an inner, cylindrical tube, said inner tube comprising a length of flexible, beverage grade tubing having a second inner diameter and a second outer diameter at least 1/16 of an inch less than the inner diameter of said outer tube, said inner tube further having a length at least thirty percent greater than that of said outer tube, said inner tube and said outer tube having a heat exchanger between their opposite surfaces, said heat exchanger comprising an air space filled with a thermally conductive, non-toxic solid, the upper end of said outer tube being attached proximate to the upper end of said inner tube in a first position such that a small section of inner tube comprising a mouthpiece is exposed above said first position, and the lower end of said outer tube being attached to said inner tube at a second position such that a section of at least 2 inches in length of said inner tube comprising an intake end is exposed below said second position, said thermally conductive, non-toxic solid being sealed between the opposite surfaces of said inner tube and said outer tube between said first position and said second position, whereby said heat exchanger portion of said device, after suitable refrigeration, remains essentially unsubmerged in said beverage thereby allowing the bulk of the beverage to retain its hot temperature while said heat exchanger portion cools only that liquid drawn therethrough by the user's mouth.

2. A drinking device for modulating liquid's temperature in accordance with claim 1, wherein said solid has a color.

3. A drinking device for modulating a liquid's temperature in accordance with claim 1, wherein the ends of said outer tube are hermetically sealed to said inner tube.

4. A drinking device for modulating a liquid's temperature in accordance with claim 1, wherein the ends of said outer tube are heat sealed to said inner tube.

5. A drinking device for modulating a liquid's temperature in accordance with claim 1, wherein the ends of said outer tube are chemically sealed with an adhesive to said inner tube.

6. A drinking device for modulating a liquid's temperature in accordance with claim 1, wherein said air space is sealed with formed, pliable caps which are inserted between said inner tube and said outer tube at both ends of said outer tubes.

7. A drinking device for modulating a liquid's temperature in accordance with claim 6, wherein said formed, pliable caps have a central opening sized to snugly receive said inner tube, a flanged outer rim to snugly seal against the inner surface of said outer tube and having a diameter at least as great as the first inner diameter of said outer tube.

8. A drinking device for modulating a liquid's temperature in accordance with claim 1, wherein said outer tube and said inner tube have sufficient flexibility to describe a 45° arc without collapsing.

9. A drinking device for modulating a liquid's temperature in accordance with claim 1, wherein said inner tube has a length from 5 inches to 18 inches.

10. A drinking device for modulating a liquid's temperature in accordance with claim 1, wherein said outer tube has a length form 4 inches to 15 inches.

11. A drinking device for modulating a liquid's temperature in accordance with claim 1, wherein said thermally conductive, non-toxic solid comprises polyethylene beads.

12. A drinking device for modulating a liquid's temperature in accordance with claim 11, wherein said polyethylene beads have a diameter of from 0.01 mm to 5 mm.

13. A drinking device for modulating a liquid's temperature in accordance with claim 11, wherein said polyethylene beads have a bore therethrough whereby surface area is increased.

14. A drinking device for modulating a liquid's temperature in accordance with claim 1, wherein said thermally conductive, non-toxic solid comprises polypropylene beads.

15. A drinking device for modulating a liquid's temperature in accordance with claim 14, wherein said polypropylene beads have a diameter of from 0.1 mm to 5 mm.

16. A drinking device for modulating a liquid's temperature in accordance with claim 14, wherein said polypropylene beads have a bore therethrough whereby surface area is increased.

17. A drinking device for modulating a liquid's temperature in accordance with claim 1, wherein said thermally conductive, non-toxic solid comprises polyurethane foam.

18. A drinking device for modulating a liquid's temperature in accordance with claim 1, wherein the materials for said tubing is selected from the group consisting of beverage grade tygon, P.E.T., and polypropylene.

* * * * *